US007976181B2

(12) United States Patent
Kelly et al.

(10) Patent No.: US 7,976,181 B2
(45) Date of Patent: Jul. 12, 2011

(54) DISPLAY CABINET ILLUMINATION

(75) Inventors: William Kelly, County Cork (IE); John Bouchier, County Cavan (IE); Paul O'Shaughnessy, County Galway (IE); Austin Duke, Dublin (IE)

(73) Assignee: Nualight Limited, Cork (IE)

( * ) Notice: Subject to any disclaimer, the term of this patent is extended or adjusted under 35 U.S.C. 154(b) by 0 days.

(21) Appl. No.: 12/974,290

(22) Filed: Dec. 21, 2010

(65) Prior Publication Data

US 2011/0090674 A1 Apr. 21, 2011

Related U.S. Application Data

(63) Continuation of application No. 12/382,886, filed on Mar. 26, 2009, now Pat. No. 7,871,176, which is a continuation of application No. 11/793,800, filed as application No. PCT/IE2005/000149 on Dec. 23, 2005, now Pat. No. 7,513,637.

(30) Foreign Application Priority Data

Dec. 23, 2004 (IE) ..... 2004/0859
Jun. 10, 2005 (IE) ..... 2005/0392

(51) Int. Cl.
*F21S 4/00* (2006.01)

(52) U.S. Cl. ..... 362/217.12; 362/249.02; 362/125

(58) Field of Classification Search ..... 362/125, 362/126, 249.02, 92, 217.12, 217.13; 312/223.5
See application file for complete search history.

(56) References Cited

U.S. PATENT DOCUMENTS

| | | | | |
|---|---|---|---|---|
| 5,699,676 | A | 12/1997 | Trulaske, Sr. | 62/264 |
| 6,045,240 | A | 4/2000 | Hochstein | 362/294 |
| 6,179,434 | B1 * | 1/2001 | Saraiji | 362/125 |
| 6,550,269 | B2 | 4/2003 | Rudick | 62/440 |
| 6,880,952 | B2 | 4/2005 | Kiraly et al. | 362/218 |
| 7,121,675 | B2 | 10/2006 | Ter-Hovhannisian | 362/92 |
| 7,600,887 | B2 * | 10/2009 | Sherman | 362/125 |
| 2003/0137828 | A1 | 7/2003 | Ter-Hovhannisian | 362/92 |
| 2007/0285920 | A1 | 12/2007 | Seabrook | 362/240 |

FOREIGN PATENT DOCUMENTS

| | | | |
|---|---|---|---|
| DE | 20215834 | U1 | 4/2004 |
| EP | 0709050 | A1 | 5/1996 |
| JP | 2004-186105 | | 7/2004 |
| WO | WO9857571 | * | 12/1998 |
| WO | WO01/00065 | | 1/2001 |
| WO | WO03/102467 | | 12/2003 |

* cited by examiner

*Primary Examiner* — Ali Alavi
(74) *Attorney, Agent, or Firm* — Jacobson Holman PLLC

(57) ABSTRACT

An illuminator comprises an elongate body; and engagement means for engaging a display cabinet shelf at a front edge. Light emitting diodes are mounted on inner surfaces of the body for product illumination. The diodes are mounted for mutually divergent and at least partially inwardly-directed fields of illumination. The diodes include a top set of diodes arranged for illumination above a shelf and a bottom set of diodes for illumination below a shelf. The illuminator may further comprise a light guide for direction of light from behind the diodes to an outer surface of the body, and the diodes being mounted on a transparent substrate. The body may comprise a label holder for supporting a label across an outer surface of the body.

14 Claims, 12 Drawing Sheets

DISPLAY CABINET ILLUMINATION

This application is a Continuation Application of U.S. patent application Ser. No. 12/382,886, filed Mar. 26, 2009, now U.S. Pat. No. 7,871,176 which is a Continuation Application of U.S. patent application Ser. No. 11/793,800 filed Jun. 21, 2007, issued as U.S. Pat. No. 7,513,637, which in turn was the national stage application of PCT/IE05/000149 filed Dec. 23, 2005, which claims priority to Irish application no. 2004/0859 filed Dec. 23, 2004 and claims priority to Irish application no. 2005/0392 filed on Jun. 10, 2005, all of which are incorporated by reference herein.

INTRODUCTION

1. Field of the Invention

The invention relates to lighting systems for the illumination of goods in retail premises, for example in temperature-controlled or refrigerated display cases, freezers, coolers, and other types of case.

2. Prior Art Discussion

At present, fluorescent light fittings are typically used for this application. However, these suffer from being bulky, and thus inconvenient for use in restricted spaces such as in refrigerated display cases. Another problem is that they have a short life and require frequent maintenance. A still further problem is high power consumption.

Also, fluorescent lighting operates at a hazardous high voltage with the requirements of a starter/ballast which can output up to 600 Volts. Fluorescent lighting is fragile and contains mercury. The fragile nature of a fluorescent glass tube potentially exposes personnel and displayed product to glass fragments, mercury, and high voltage if a tube is broken.

Another problem is that fluorescent tubes are available in a limited range of fixed lengths (for example, multiples of 30 cm long) and cannot be reduced/extended in size to exactly match the length of the retail case.

Also, fluorescent light output substantially reduces in cold temperatures and can also have a problem with starting/switching-on. This leads to unsatisfactory performance, a reduced life, and a disimprovement in the aesthetic quality and functionality of the lighting.

Fluorescent lighting emits light through 360°. This requires the use of bulky light reflectors to efficiently utilise the light output.

WO01/00065 and U.S. Pat. No. 6,550,269 describe use of LEDs for illuminating retail display cases or cabinets.

The invention is therefore directed towards providing an improved illuminator for display cases or cabinets.

SUMMARY OF THE INVENTION

According to the invention, there is provided an illuminator comprising:

an elongate body;

engagement means for engaging a display cabinet;

a plurality of light emitting diodes mounted on an inner surface of said body for product illumination; and wherein the elongate body comprises a heat transfer portion for conduction of heat from the light emitting diodes to an outer surface of the body.

In one embodiment, the light emitting diodes are arranged in a line

In another embodiment, the light emitting diodes are mounted in a plurality of lines.

In a further embodiment, the diodes are mounted for mutually divergent and at least partly inwardly-directed fields of illumination.

In one embodiment, the body is of extruded metal.

In another embodiment, the body is of extruded aluminium.

In a further embodiment, the body comprises opposed rails for snap-fitting engagement of a protective cover over the diodes.

In one embodiment, an illuminator further comprises an optical component for focusing or directing emitted light.

In another embodiment, the optical component comprises a reflector on a surface of the body.

In a further embodiment, an illuminator further comprises a light guide for direction of light from behind the diodes to the outer surface, and the diodes are mounted on a transparent substrate.

In one embodiment, the body comprises a label holder for supporting a label across the outer surface.

In another embodiment, the label holder comprises a pair of opposed grooves or ridges for supporting a label.

In a further embodiment, the body is configured to also act as a structural member for a display cabinet, the engagement means being incorporated in the ends of the body for engagement with other structural members of a display cabinet.

In one embodiment, the body has a substantially planar outer surface.

In another embodiment, an illuminator further comprises a cover for an outer surface of the body, for abutting a cabinet door.

In a further embodiment, the body comprises opposed elongate grooves or ridges for support of the outer surface cover.

In one embodiment, the engagement means comprises means for engaging a shelf across its front edge.

In another embodiment, the engagement means comprises a pair of opposed ridges or lugs for snap-fitting to the front edge of a display cabinet shelf.

In another aspect of the invention, there is provided a display cabinet comprising an illuminator as defined above acting as a structural member.

DETAILED DESCRIPTION OF THE INVENTION

Brief Description of the Drawings

The invention will be more clearly understood from the following description of some embodiments thereof, given by way of example only with reference to the accompanying drawings in which:—

Referring to FIGS. 1 to 3 an illuminator 1 comprises two lines of LEDs 2 (extending in the plane out of the page). The LEDs 2 are mounted on faces 7 of an elongate extruded aluminium support 3. The support 3 has a heat transfer plate 4 which provides both structural strength and a body of metal for heat transfer from the LEDs 2. The light-emitting side of the illuminator 1 is surrounded by an elongate curved translucent cover 6 which snap-fits into a pair of opposed grooves 8 of the support 3. There is also a backing plate 5 covering the back surface of the support 3, and which snap-fits into the opposed grooves 8. The illuminator comprises current regulating chips and drivers on the same surface as the LEDs. Each illuminator is in a modular length, and multiple units may be interconnected to form the desired length. There is an external power supply connected to the illuminator at a terminal.

Figure 1:
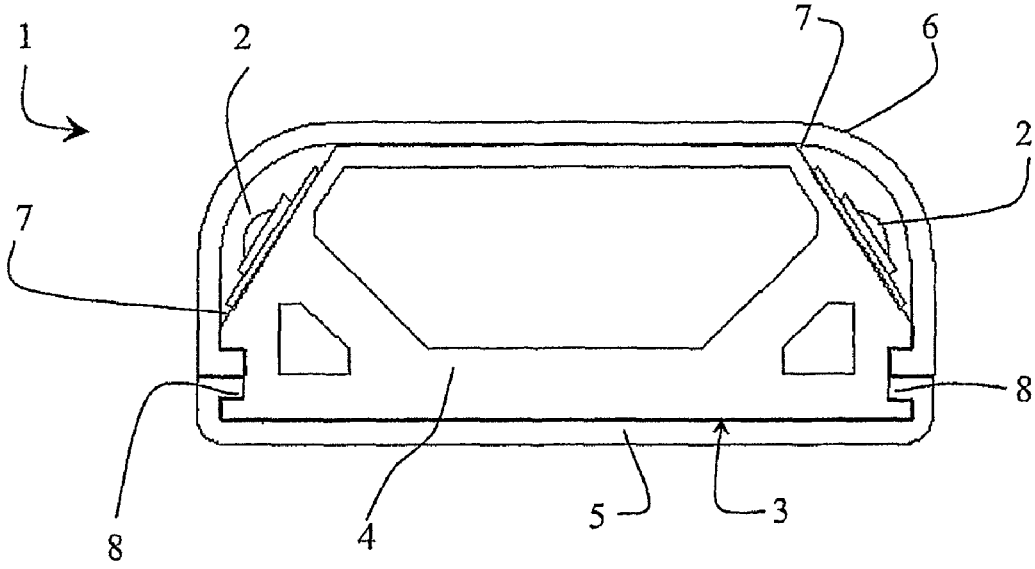
FIGS. 1 to 3 are cross-sectional (without hatching, for clarity), exploded cross-sectional, and perspective views of a display cabinet illuminator of the invention.

In use, the illuminator 1 forms a structural member of a refrigerated retail cabinet. It is a mullion, namely a central vertical support which forms part of the door frame, the doors closing against the cover 5.

Because the light sources are LEDs the many disadvantages associated with fluorescent tubes are avoided. Some of these disadvantages with fluorescent lighting relate to the difficulty in dealing with waste heat from the fluorescent tubes, ballast, and other components. Light sources used in luminaires are not perfectly efficient, and in general convert the power supplied from the power source into a combination of heat and light. In the case of prior art fluorescent tubes, much of the waste heat is generated inside the glass tube, and radiates out along with the light. The fluorescent tube is suspended between its end supports, so this waste heat radiates directly into the display case. In the case of a temperature-controlled display case, such as a freezer, refrigerator or cooler, this waste heat must be removed by the refrigeration system, and due to the inefficiency level of the refrigerator, there is a multiplier effect. Typically, for each 100 W of fluorescent lighting used in a sealed case, at least 200 W of additional refrigeration capacity is needed.

There is a need in freezer cases for additional heating strips along both the vertical mullions, and the horizontal part of the case frame, i.e. all those structural elements against which the door abuts. If these frame components are cold, so that their surfaces are colder than the dew point of the ambient air, then there will be condensation and frozen moisture deteriorating from the accessibility and visibility of the product to the shopper. In order to prevent this, heating strips are generally incorporated in the framework and referred to as "anti-sweat heaters".

In the case of LEDs, waste heat is generated in the LED junctions, which are directly connected to the luminaire body, enabling this heat to be efficiently removed from the LED junction. A typical LED luminaire for this application might in total dissipate 10 W per foot of luminaire, of which about 8 W is waste heat. In the invention, this waste heat can be almost entirely distributed to the outside surface of the mullion, where it serves to provide the necessary anti-condensation or anti-sweat heating to prevent icing up of the door as it is opened and closed in humid environments. Typical mullion heating strips use between 8 W and 12 W per foot. Thus the LED luminaires, or a combination of LEDs and a lesser amount of heating strips or elements or resistors, either within or without the LED luminaire, can provide adequate anti-condensation effects.

It is important to design the luminaire for the expected ambient conditions in the display case location. The assumed standard is typically 25 deg. C. at a relative humidity of 60%. The heat dissipation to the required mullion surface will depend upon the thermal resistance of the luminaire, from semiconductor junction to outside ambient, and ideally a value of better than 2° C./W per foot of luminaire will keep the operating temperature of the LEDs within safe limits for a typical 10 W per foot luminaire. The distribution of heat flow between internal and external mullion surfaces will be determined by the relative thermal resistance of the different available paths for heat flow, and the detailed mullion luminaire design will take account of these in optimising the design. The thermal resistance is proportional to the thermal resistivity multiplied by the path length and divided by the cross-sectional area. Thus the resistance of the desired heat flow path can be reduced compared to the alternative paths by keeping a large thin area of metal between the LED and the surface to be heated. With the invention an area of 1 sq·cm per LED, with a path length shorter than 4 mm, can be achieved, leading to excellent conduction of heat to the desired surface.

Of course, there are other considerations involved in the illuminator configuration, such as appearance, mechanical strength, and durability. The configuration involves a trade-off between these various aspects, so that the optimum performance for the application is achieved.

Figure 2:
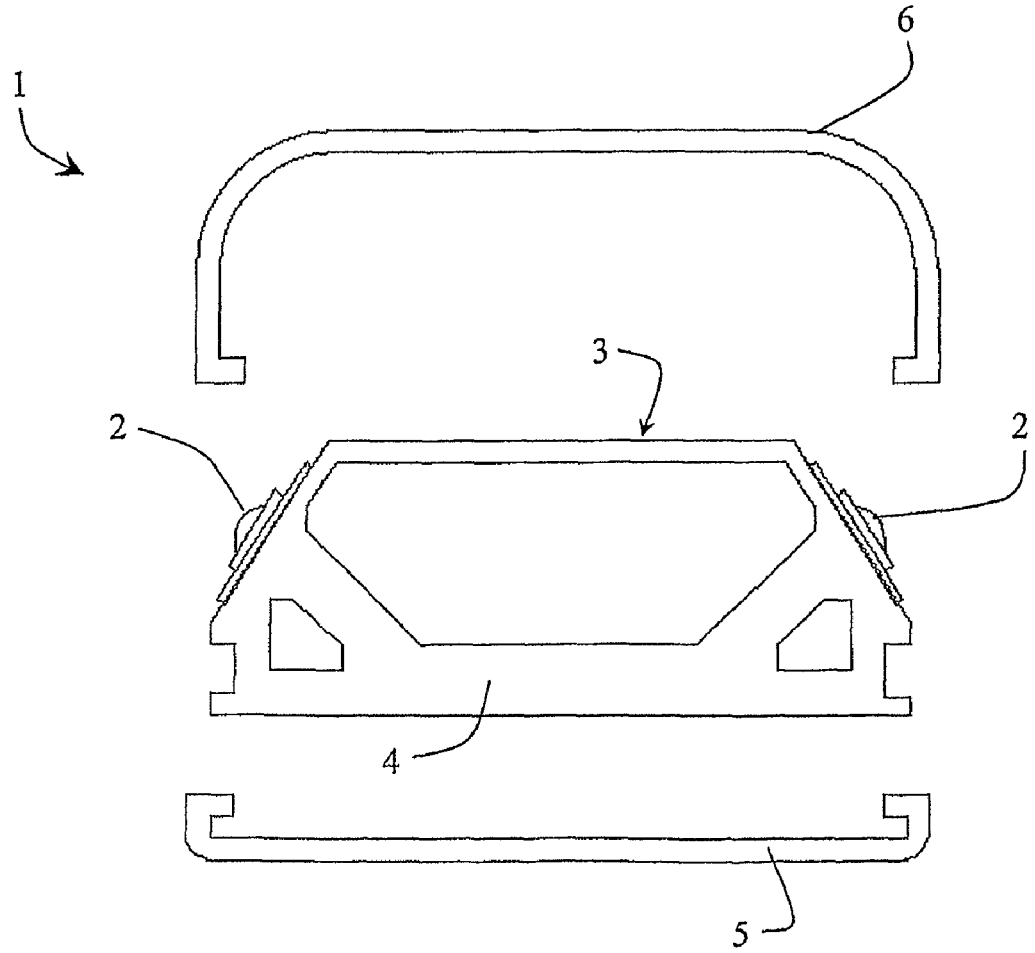
Figure 3:
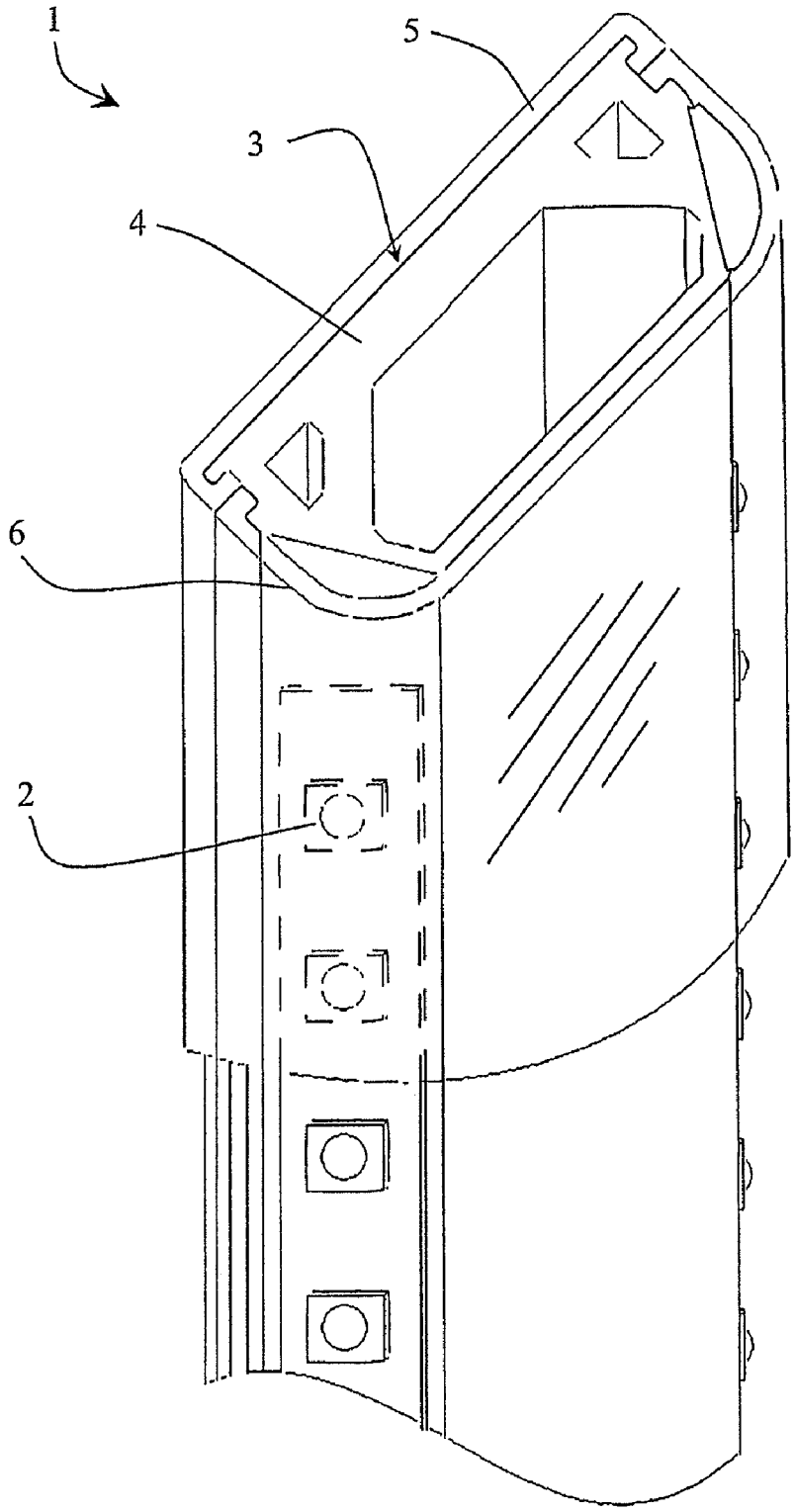

Referring again to FIGS. 1 to 3, there is considerable heat transfer from the LEDs 2 through the body 4 of the support 3. This heat is radiated from the outer cover 5 (which is plastics material), and provides the useful function of helping to prevent condensation on the glass panels of the doors. Heretofore, some display cases have incorporated a heating element which runs along the length of the mullion, in order to prevent condensation. The invention avoids need for such a heater, by tapping into the available heat from the LEDs. Thus the arrangement of the illuminator achieves the benefit of achieving a good LED reliability and avoidance of or reduced requirement for an "anti-sweat" heater, in addition to the considerable other benefits of avoiding use of fluorescent tubes.

Figure 4:
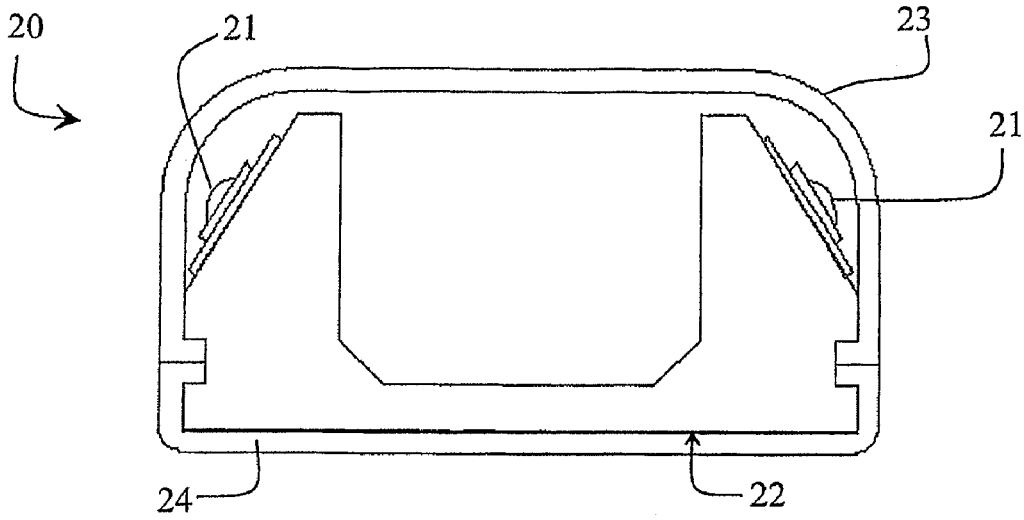
FIGS. 4 and 5 are cross-sectional and exploded cross-sectional views (without hatching) through an alternative illuminator of the invention.
Figure 5:
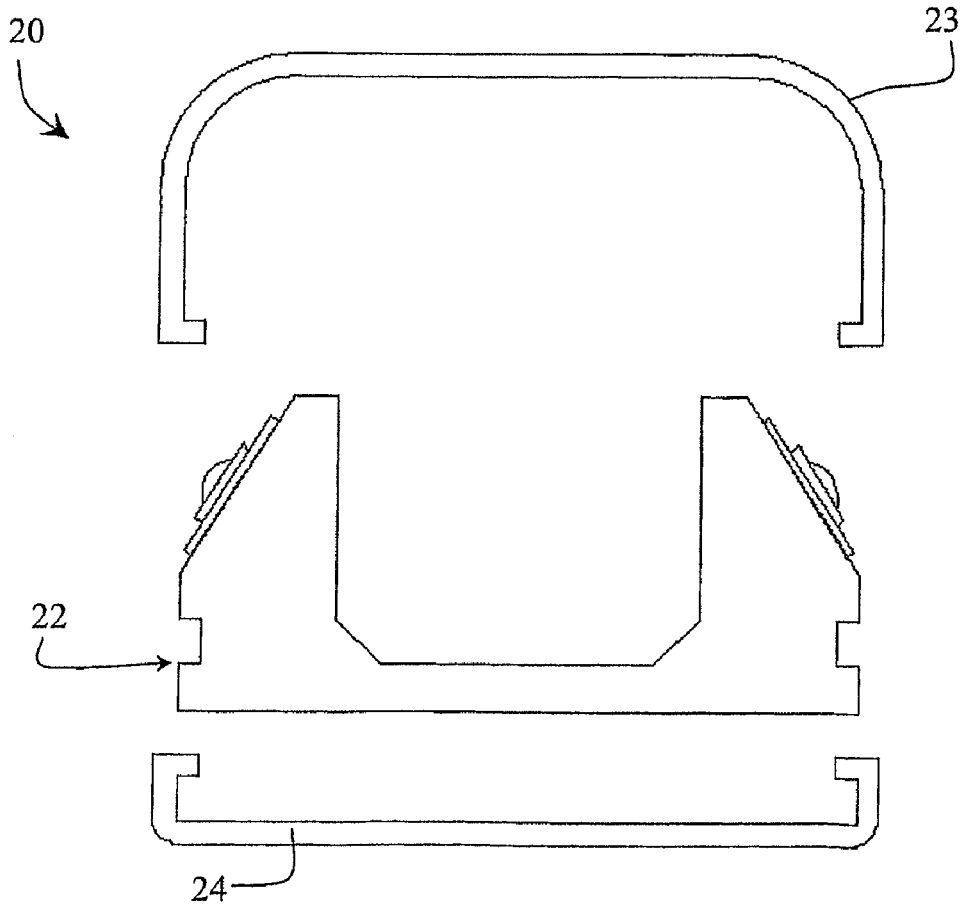

Referring to FIGS. 4 and 5 an alternative illuminator 20 has two lines of LEDs 21, on faces of a support 22. There is a transparent cover 23 and a backing plate 24. In this embodiment the support 22 has greater bulk (providing reduced thermal resistance to heat transferring to the outer surface) for even more efficient heat conduction.

Figure 6:
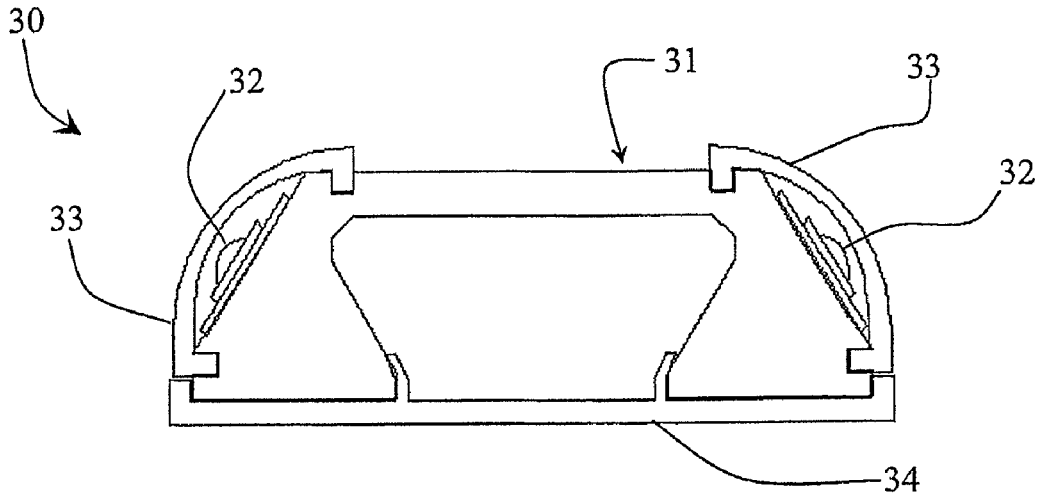
FIGS. 6 to 8 are cross-sectional, exploded cross-sectional (without hatching), and perspective views through a further alternative illuminator of the invention.
Figure 7:
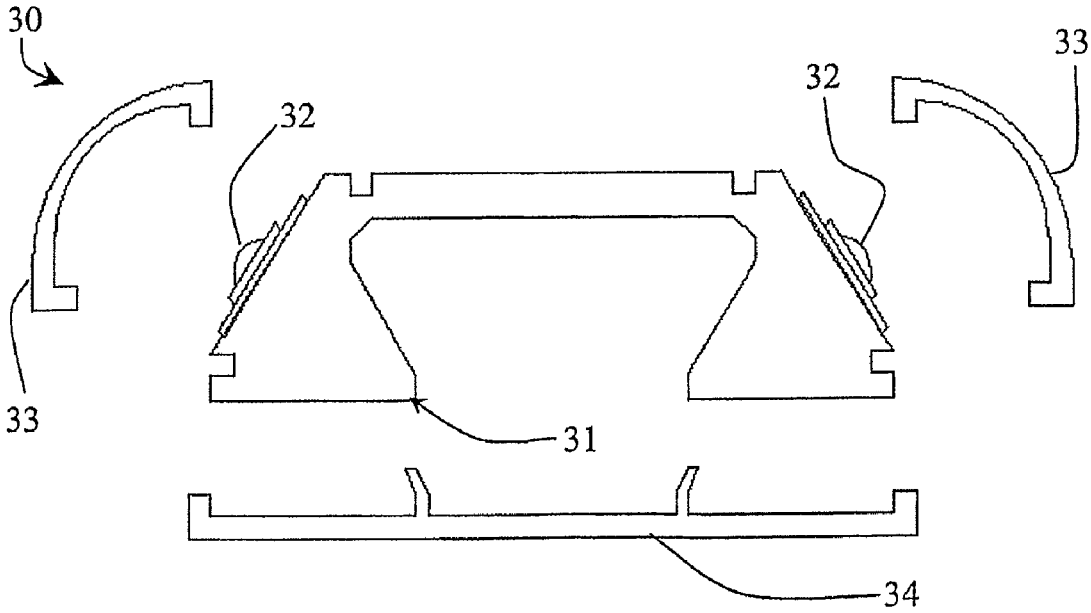
Figure 8:
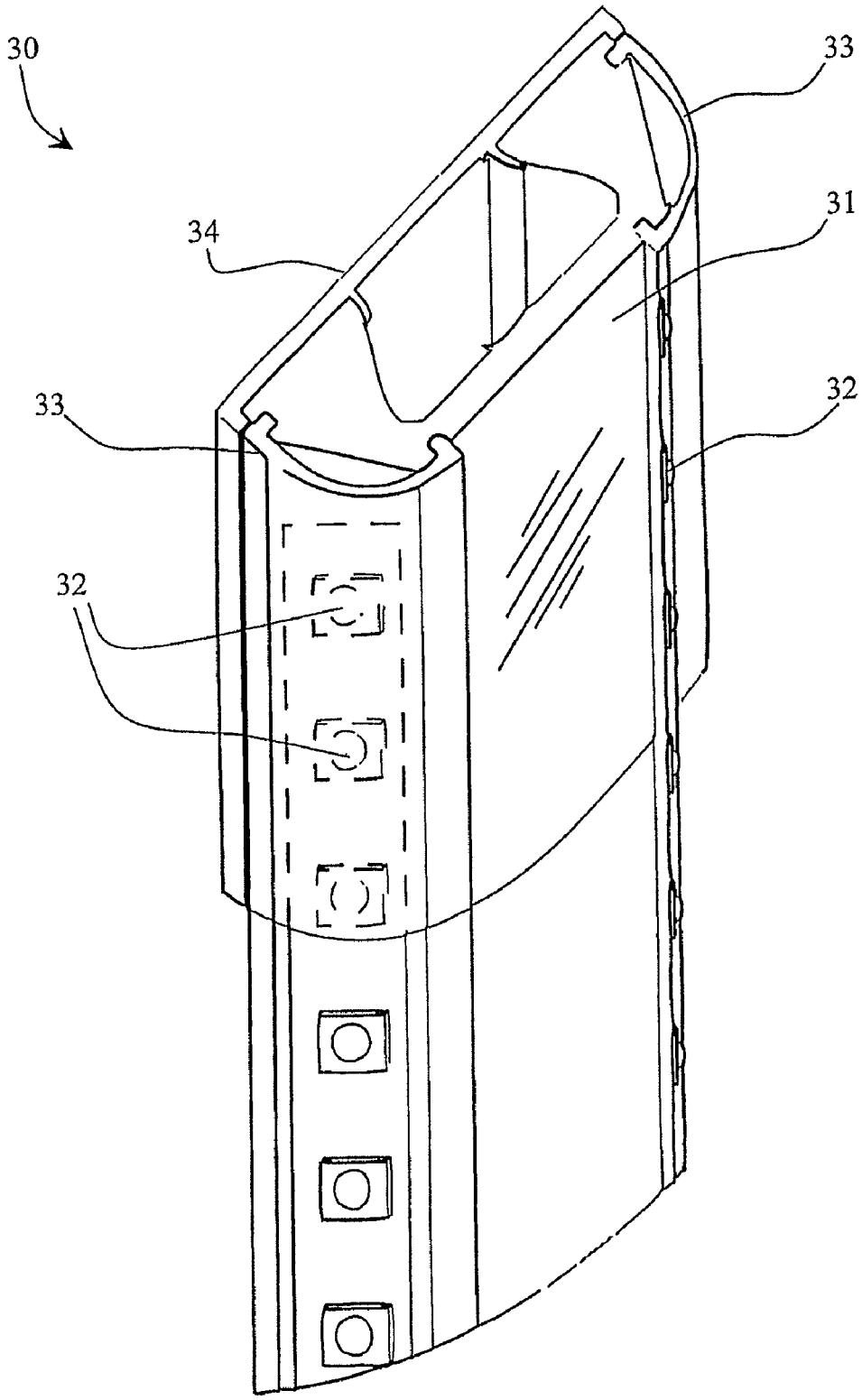

Referring to FIGS. 6 to 8 an illuminator 30 has a different support 31, two lines of LEDs 32, two transparent covers 33, and a backing plate 34. The channel within the support 31 may have a thermally conductive filler such as thermally-conductive foam to assist heat transfer, without adding to the extent of Aluminium required for the extrusion.

Figure 9:
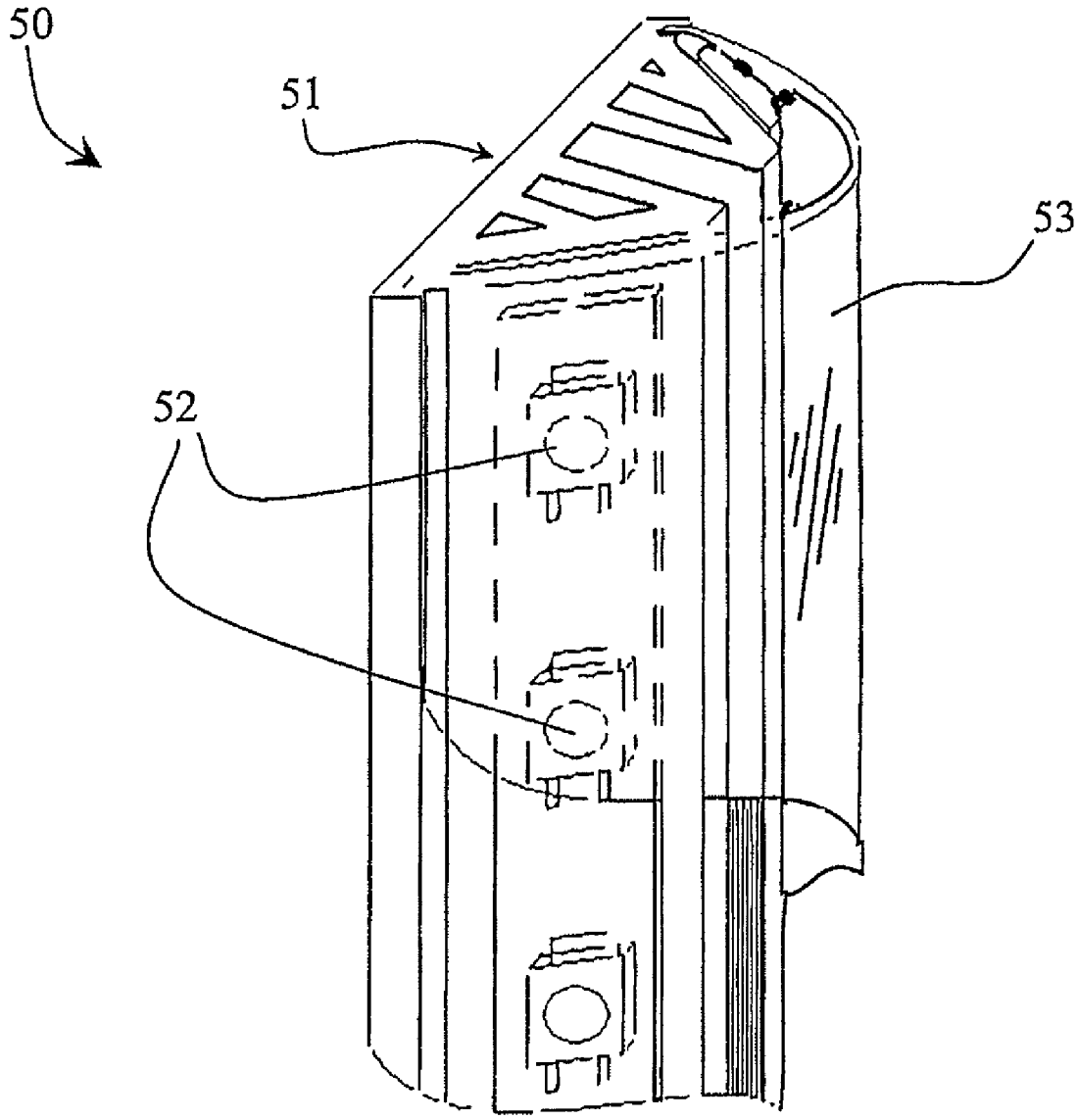
FIG. 9 is a partly cut-away perspective view of a further illuminator of the invention.

A still further illuminator, 50, is shown in FIG. 9. It has a different support 51, two lines of LEDs 52, and a curved transparent cover 53.

Figure 10:
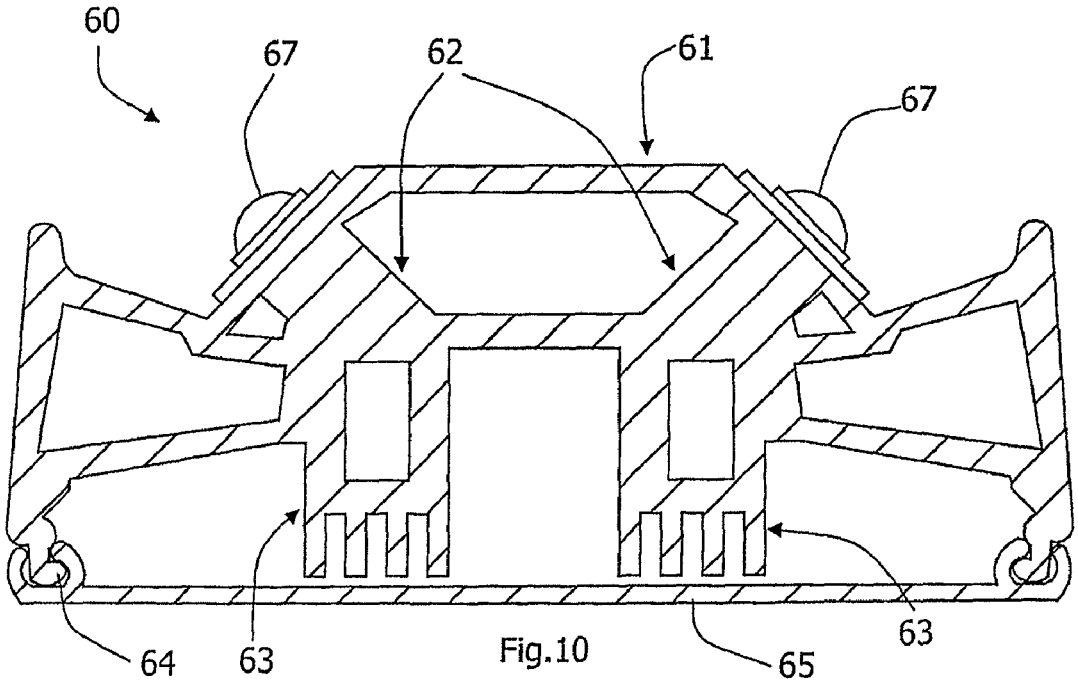
FIG. 10 is a cross-sectional view through an alternative mullion of the invention.

Referring to FIG. 10 an illuminator 60 comprises an elongate extruded aluminium body 61 having an integral heat transfer body 62 terminating in outer fins 63 which run along the length of the illuminator 60. The body 61 comprises opposed rails 64 across which are snap-fitted a cover 65. The cover 65 provides an outwardly-facing surface which abuts the display cabinet doors. The illuminator 60 further comprises two lengths of LEDs 67. An LED cover is not shown in this drawing.

In use, the illuminator 60 forms a structural mullion for the display cabinet, engaging the remainder of the cabinet structural members at its ends. The doors when closed abut the outer surface of the cover 65. The LEDs when activated direct light inwardly into the display cabinet for very effective product illumination on both sides of the illuminator 60.

Heat generated by the LEDs 67 conducts through the heat transfer body 62 to the fins 63, where it is dissipated through the cover 65 to reduce condensation on the doors.

Figure 11:
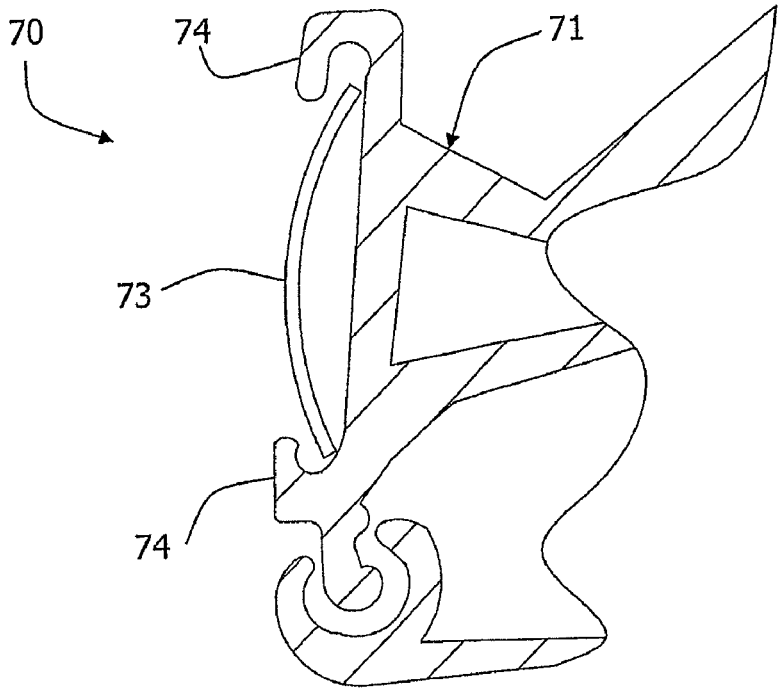
FIG. 11 is a similar view of one side of an alternative mullion.

In a variation of the illuminator 60, FIG. 11 shows an illuminator 70 which is similar except that it has on each side, a label 73 snap-fitted between label-support rails 74.

Label holders are often used either for supporting pricing and product information, or else for branding and promotional information. The ability to combine this information function with the structural and heat dissipating aspects of the LED luminaire is very beneficial, as explained below. There are additional opportunities to use some of the LED light to display the information to the customer to better advantage, or to use some of the LED light to improve the overall appearance and aesthetics of the luminaire's structure.

Figure 12:
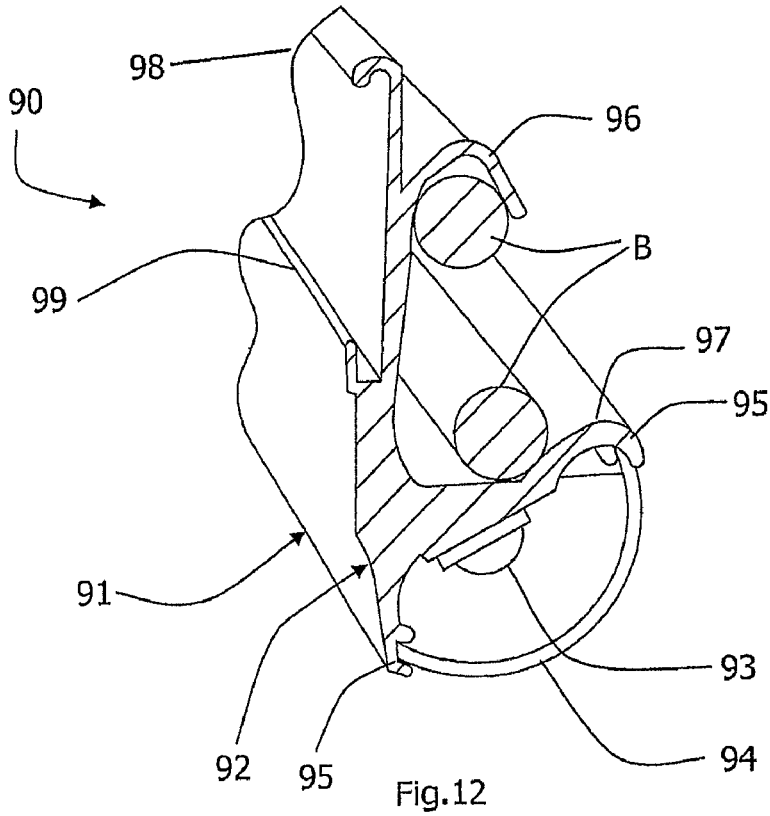
FIG. 12 is a perspective cut-away view of a further illuminator of the invention.

Referring to FIG. 12, an illuminator 90 comprises an integral extruded aluminium body 91 having a heat transfer portion 92. The illuminator 90 has a line of LEDs 93 mounted on a lower surface of the body 91, facing downwardly. An elongate cover 94 is snap-fitted between opposed rails 95 to protect the LEDs 93 and to prevent injury to a person touching them. The body 91 has opposed rails 96 and 97 for snap-fitting onto traverse bars B of a display cabinet shelf. The body 91 also forms opposed label-holding rails 98 and 99.

In this embodiment the illuminator 90 also provides heat transfer to the outside of the display cabinet, and the additional function of being a label holder. Thus, a single illuminator illuminates product in the cabinet, supports a label and provides heat in the region of the doors, thereby reducing condensation if the cabinet is a freezer cabinet.

In some instances, the illuminator is not used in an enclosed display cabinet, such as at the outer edges of open shelves. In this use the outwardly-directed heat transfer is less beneficial, but still helps to minimise the extent to which the heat counteracts the refrigeration of the products.

Figure 13:
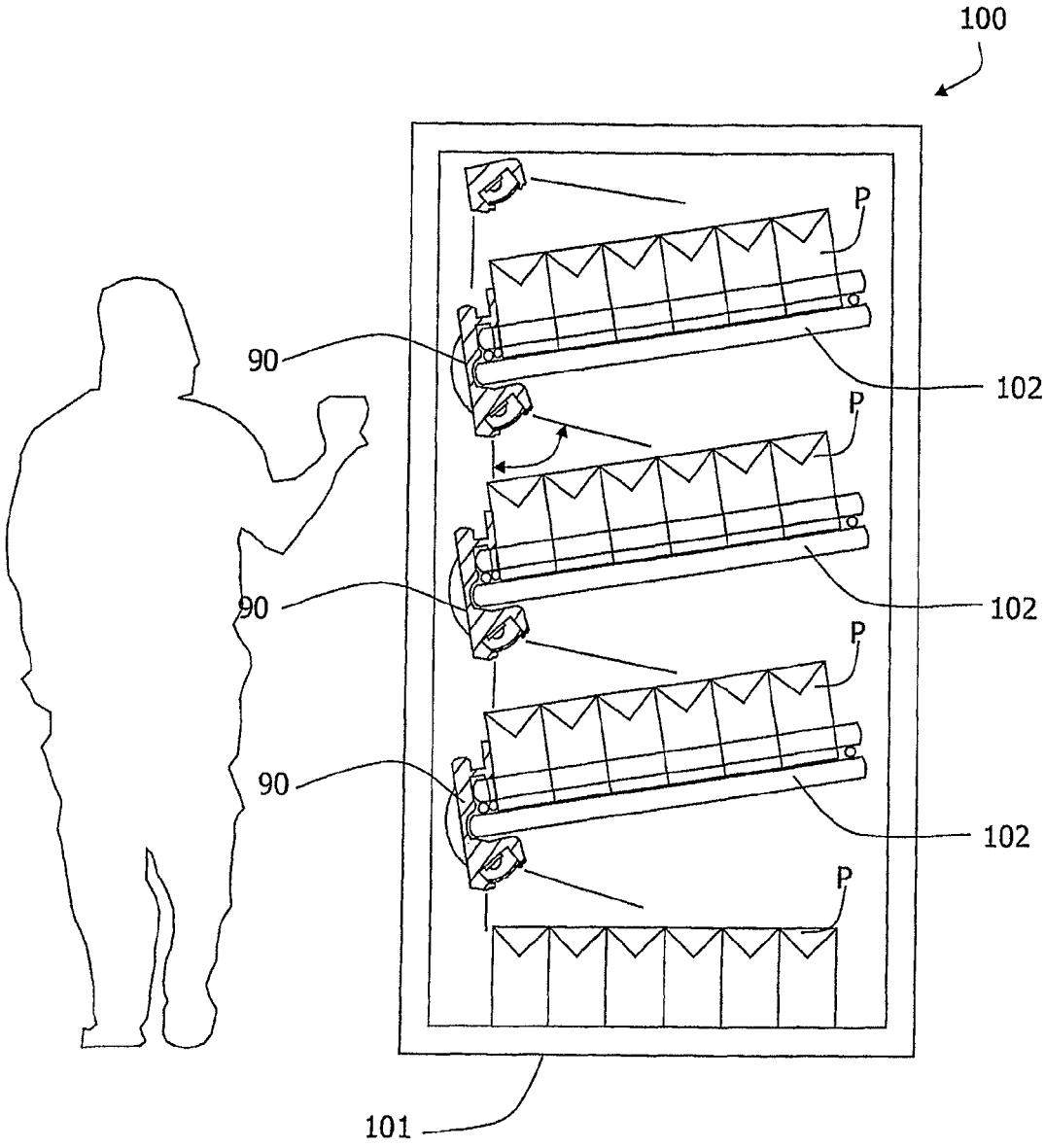
FIG. 13 is a diagrammatic side view of a display cabinet incorporating the illuminators of FIG. 12.

Referring to FIG. 13 a display cabinet 100 has shelves 102 supporting products P. The products P and also labels on the illuminators are simultaneously illuminated as shown in this drawing.

Figure 14:
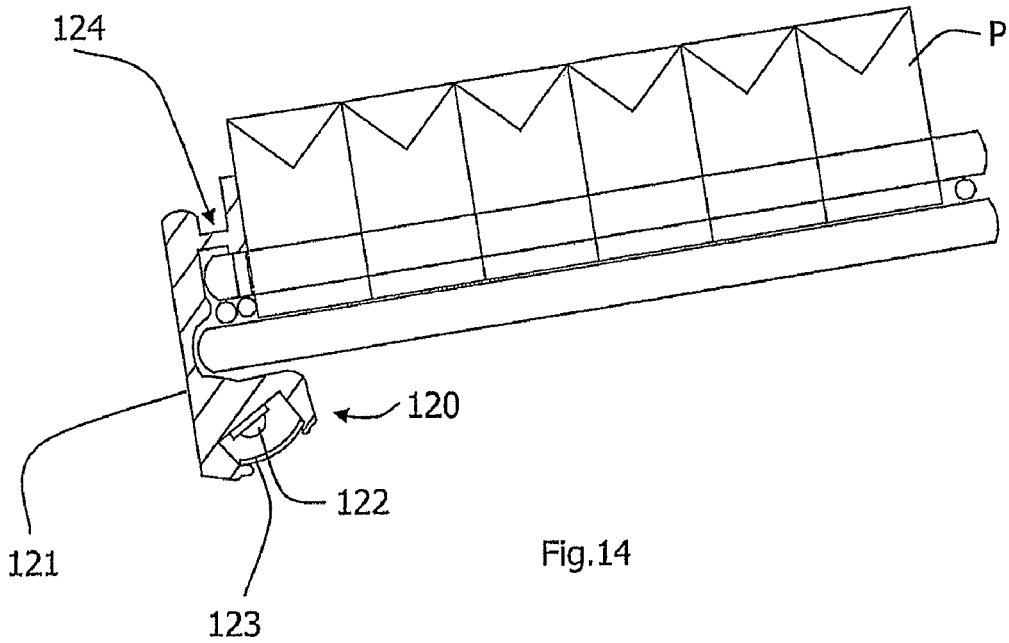
FIG. 14 is a side cross-sectional view of a further illuminator attached to a display cabinet shelf.

A further illuminator, 120, is shown in FIG. 14. This has an extruded aluminium elongate body 121 supporting downwardly-directed LEDs 122 protected by a cover 123. The body 121 forms a barrier 124 as a stop for gravity-fed products P.

Figure 15:
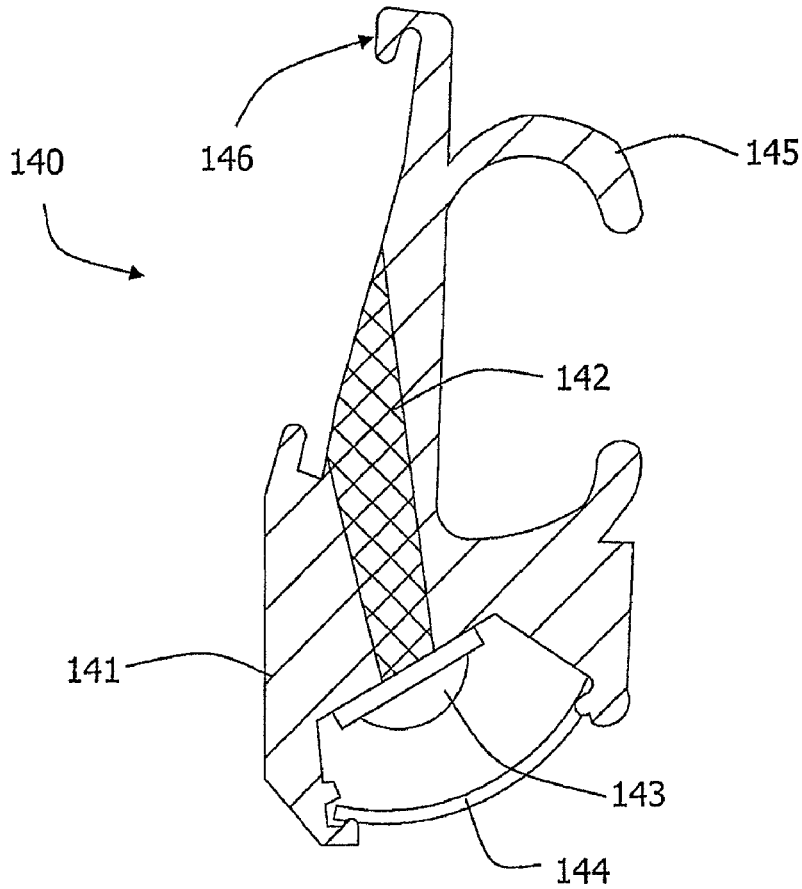
FIG. 15 is a cross-sectional view through a further illuminator.

Referring to FIG. 15, an illuminator 146 provides the same general functions as the illuminator 90. In this embodiment there is an elongate extruded aluminium body 141 containing an elongate light guide, or several discrete light guide insets of polymer material. As before, there are LEDs 143, a cover 144, snap-fitting lugs or rails 145, and a label support 146. The substrate is transparent, so that some light can propagate outwardly through the light guide 142 to illuminate a label from behind. As is clear from FIG. 15, there still remains good heat conduction outwardly.

Figure 16:
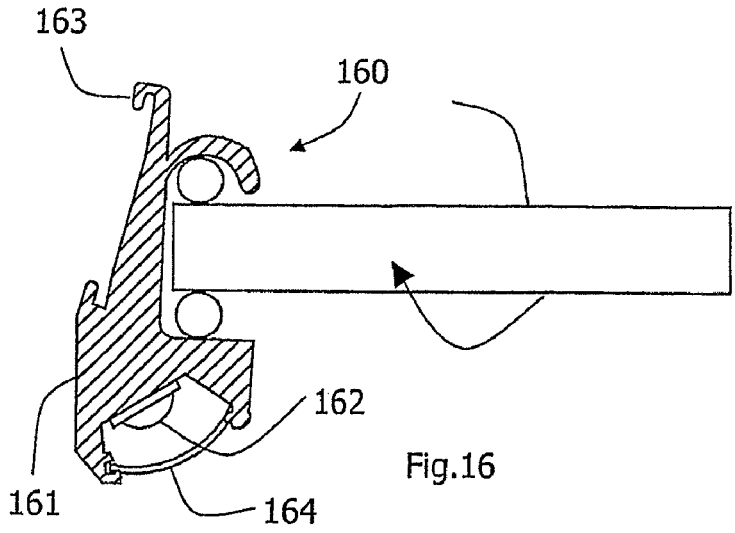
FIGS. 16 and 17 are cross-sectional views showing a further illuminator in use in different configurations.
Figure 17:
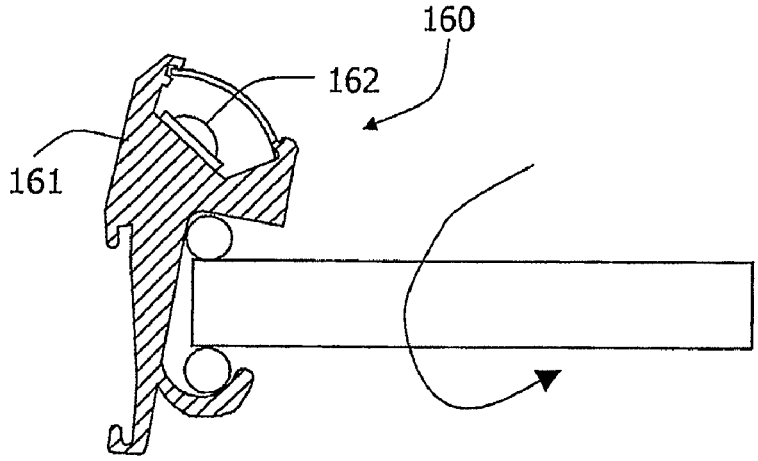

FIGS. 16 and 17 show how an illuminator 160 of similar general construction may be mounted to illuminate above or below. In this embodiment the illuminator 160 has an elongate body 161, LEDs 162, label-retaining rails 163, and an LED cover 164.

Figure 18:
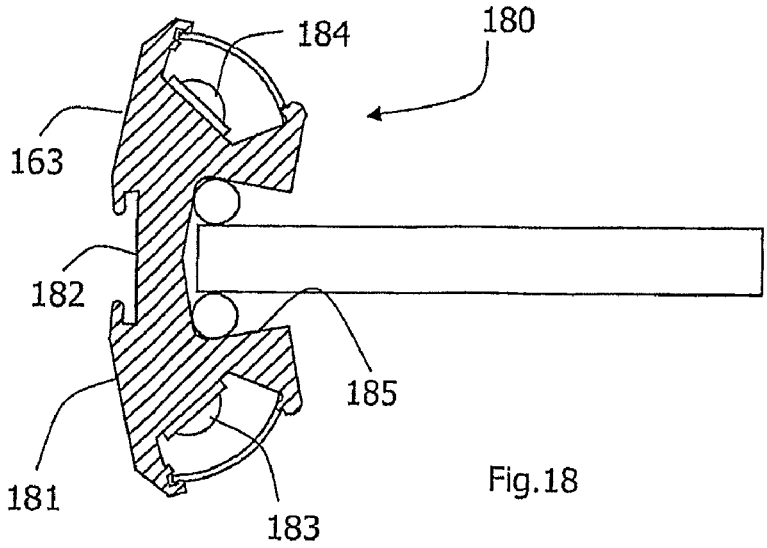
FIG. 18 is a cross sectional view of a further illuminator in use.

Referring to FIG. 18, an illuminator 180 has a body 181 which is symmetrical, having a single control label holder 182, a line of bottom LEDs 183, a line of top LEDs 184, and a central groove 185 for engagement with the front of a shelf.

Figure 19:
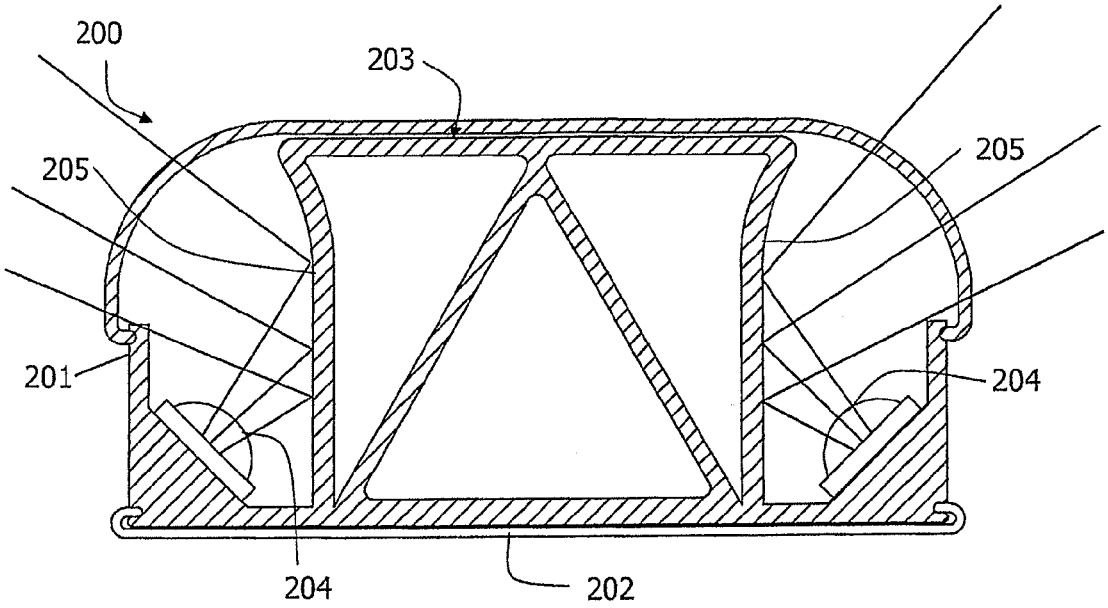
FIGS. 19 and 20 are cross-sectional views of still further illuminators of the invention.

Referring to FIG. 19 an illuminator 200 has an extruded aluminium body 203 to act a a mullion. There is an outside cover 202 for abutting cabinet doors. The body 203 has a web across its outer side, supporting two lines of LEDs 204. An inwardly-directed part of the body 203 has two curved surfaces 205 located and configured to act as reflectors for light from the LEDs 204. These act to both determine the direction of the beam of light, and to control the field of illumination, depending upon their surface shape and general orientation. An additional useful feature is a lip 201 on each side that can shield the light sources from direct visibility to shoppers.

Figure 20:
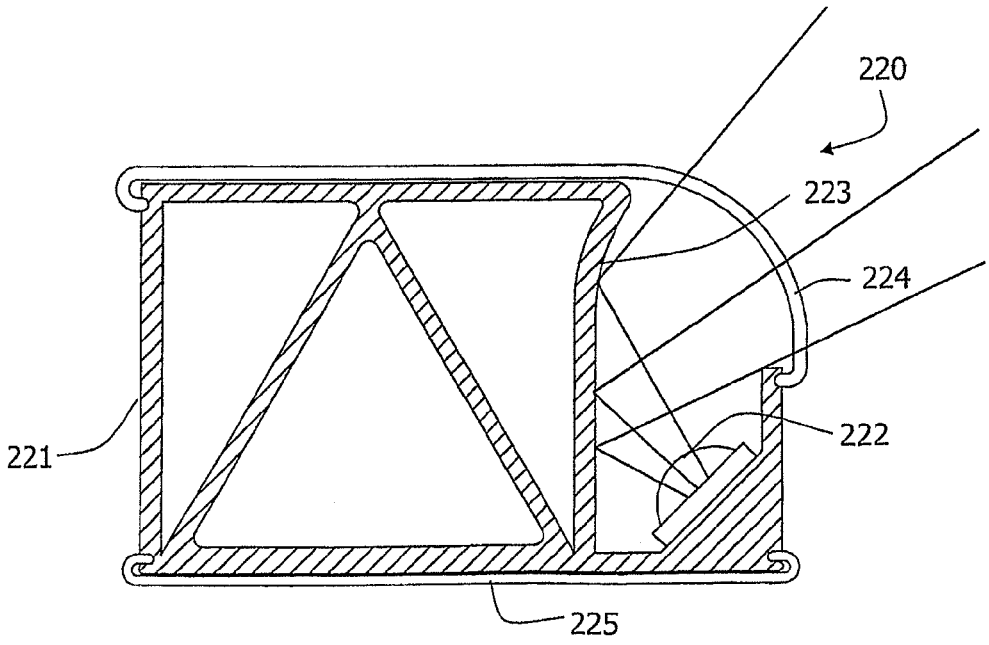

FIG. 20 shows an illuminator 220 which is a variation of the illuminator 200, having a body 221, a single line of LEDs 222, an inner cover 223 and an outer cover 224.

In the latter two embodiments, there is a shorter heat path to the outer surface, allowing greater heat transfer to the outside. The fact that the LEDs are therefore further from the inside of the cabinet is alleviated somewhat by the reflectors 205 and 223. These surfaces may or may not be polished. It will be appreciated that most of the heating effect of the illuminator is directed to the outside lateral sides, closest to the doors, where the strongest anti-condensation effect is required. In alternative embodiments, there may be prisms, total internal reflective surfaces, lenses, reflectors or any combination of these to achieve the desired optical effect. The illuminator 220 is particularly effective for use an end-mullion, used in the end door of a row of freezer doors.

The following summarises some advantages of the illuminators of the invention, in which comparisons are with fluorescent strip lighting.

Significant energy savings.
Safe:—low DC voltage/non-fragile.
Low maintenance.
Longer operating lifetime, c. five years.
Immediate illumination at switch-on.
Improved operation in low temperature.
High quality light output.
Improved visual colour rendition.
Full-colour spectrum available.
Low profile and scaleable lengths can be mounted in confined spaces which maximises product illumination and reduces unwanted shadowing.
Low energy consumption reduces the heat transferred into the freezer thereby improving the refrigeration cycle efficiency.
Multiple functions in one device: illumination, anti-condensation heating, and label-holding.

It will be appreciated that the illuminator is particularly effective at providing reflection of light for illumination of goods in confined spaces in display cases.

The invention is not limited to the embodiments described but may be varied in construction and detail. The body can be bracket-mounted or may include fixing/locating holes to enable it to be mounted onto a display wall, panel, framework, door, canopy or shelf.

The body can have end caps which have access ports to allow for cable connections to the LED panels. End caps also act as protective covers.

An illuminator may include a mounting position for a lighting control switch or knob. Also, an illuminator may be scaleable to exactly match the length of the case.

The invention is not limited to the embodiments described but may be varied in construction and detail. For example, the diodes may be mounted to face outwardly (such as for enhanced label back-lighting) in addition to forwardly. Also, where the illuminator also forms a structural member, it may be of any other suitable type such as a horizontal door frame member.

The invention claimed is:

1. An illuminator comprising:

an elongate body;

engagement means for engaging a display cabinet shelf at a front edge;

a plurality of light emitting diodes mounted on inner surfaces of said body for product illumination;

wherein the diodes are mounted for mutually divergent and at least partially inwardly-directed fields of illumination; and wherein the diodes include a top set of diodes arranged for illumination above a shelf and a bottom set of diodes for illumination below a shelf.

2. The illuminator as claimed in claim 1, wherein each set of diodes is arranged in a line.

3. The illuminator as claimed in claim 1, wherein each set of diodes is arranged in a plurality of lines.

4. The illuminator as claimed in claim 1, wherein the body is of extruded metal.

5. The illuminator as claimed in claim 1, wherein the body is of extruded aluminium.

6. The illuminator as claimed in claim 1, wherein the illuminator further comprises a light guide for direction of light from behind the diodes to an outer surface of the body, and the diodes are mounted on a transparent substrate.

7. The illuminator as claimed in claim 1, wherein the body comprises a label holder for supporting a label across an outer surface of the body.

8. The illuminator as claimed in claim 1, wherein the body comprises a label holder for supporting a label across an outer surface of the body, and wherein the label holder comprises a pair of opposed grooves or ridges for supporting a label.

9. The illuminator as claimed in claim 1, wherein the engagement means comprises a pair of opposed ridges or lugs for snap-fitting to a display cabinet shelf front edge.

10. The illuminator as claimed in claim 1, wherein the body comprises opposed rails for each set of diodes for snap-fitting engagement of a protective cover over each set of diodes.

11. The illuminator as claimed in claim 1, further comprising an optical component for focusing or directing emitted light.

12. The illuminator as claimed in claim 11, wherein the optical component comprises a reflector.

13. The illuminator as claimed in claim 1, wherein the illuminator is symmetrical about a plane between the two sets of diodes.

14. A display cabinet comprising at least one shelf and an illuminator engaging said shelf at a front edge of said shelf, the illuminator comprising:

an elongate body;

engagement means for engaging the display cabinet shelf at the front edge;

a plurality of light emitting diodes mounted on an inner surface of said body for product illumination;

wherein the diodes are mounted for mutually divergent and at least partially inwardly-directed fields of illumination; and wherein the diodes include a top set of diodes arranged for illumination above the shelf and a bottom set of diodes for illumination below the shelf.

* * * * *